US008407859B1

(12) United States Patent
Mitchell et al.

(10) Patent No.: US 8,407,859 B1
(45) Date of Patent: Apr. 2, 2013

(54) HINGE

(75) Inventors: Brett A Mitchell, Newnan, GA (US); Thomas A Thorsen, Wedowee, AL (US)

(73) Assignee: Kason Industries, Inc., Newnan, GA (US)

( * ) Notice: Subject to any disclaimer, the term of this patent is extended or adjusted under 35 U.S.C. 154(b) by 0 days.

(21) Appl. No.: 13/234,813

(22) Filed: Sep. 16, 2011

(51) Int. Cl.
*E05F 1/02* (2006.01)

(52) U.S. Cl. ..... 16/312; 16/303; 16/309

(58) Field of Classification Search ..... 16/303, 16/309, 310, 312, 316, 304, 306, 273, 342; 49/386, 239, 236–238; 312/326, 327, 321.5
See application file for complete search history.

(56) References Cited

U.S. PATENT DOCUMENTS 3,065,035 A * 11/1962 Biesecker ..... 384/296
3,451,124 A * 6/1969 Steiner et al. ..... 29/527.1
3,499,183 A * 3/1970 Parsons ..... 16/273
3,599,275 A * 8/1971 Granzow ..... 16/275
3,748,688 A * 7/1973 Berkowitz ..... 16/247
4,030,161 A * 6/1977 Loikitz ..... 16/284
4,573,239 A * 3/1986 Valenti et al. ..... 16/273
4,631,777 A * 12/1986 Takimoto ..... 16/315
4,675,940 A * 6/1987 Brockhaus ..... 16/273
5,463,795 A * 11/1995 Carlson et al. ..... 16/273
6,173,475 B1 * 1/2001 Senn et al. ..... 16/273
6,751,938 B1 * 6/2004 Llongueras ..... 57/90
7,945,996 B2 * 5/2011 Gunderson ..... 16/312

* cited by examiner

*Primary Examiner* — Chuck Y. Mah
(74) *Attorney, Agent, or Firm* — Baker, Donelson; Dorian B. Kennedy

(57) ABSTRACT

A riser hinge (10) is disclosed which includes a mounting flange assembly (12) pivotally coupled to a strap assembly (15). The cylindrical portion (52) includes an upper strap bearing (54) and a lower strap bearing (55) which are each mounted partially within the cylindrical portion. The strap cylinder portion has a space (82) which includes an enlarged portion (83) flanked by narrowed portions (84) at stop ledges (85). The upper strap bearing and lower strap bearing each have a vertically oriented, elongated, locking tongue or flange (87) with a narrowed portion (88) extending to an enlarged portion or stop (89), which enables them to be removably mounted within the space.

12 Claims, 7 Drawing Sheets

HINGE

TECHNICAL FIELD

This invention relates to door hinges, and, more particularly, to hinges used on heavy doors such as on commercial refrigerators and the like.

BACKGROUND OF THE INVENTION

Heavy doors, such as those used on walk-in refrigerators, are often mounted to jambs by large industrial type hinges. Sometimes, these large hinges also lift the door when it is swung open, and use gravity to assist in the closing of the door. These hinges usually have two barrels mounted one above the other which include low friction bearings press fitted therein.

A problem occurs when through use of the door the internal bearings becomes worn and the hinge ceases to operate in the correct manner. When this occurs, the installer typically replaces the entire hinge. This problem is especially prevalent when the hinge is a riser type hinge which includes camming components that increase the wear due to the forced rising of the door.

It thus is seen that a need remains for a heavy duty hinge which alleviates problems associated with those of the prior art. It is to the provision of such therefore that the present invention is primarily directed.

SUMMARY OF THE INVENTION

In a preferred form of the invention, a hinge for doors being suited from mating engagement with an associated cabinet or jamb comprises a mounting flange adapted to be mounted to a jamb, the mounting flange having an upper hinge arm and a lower hinge arm, and a strap assembly adapted to be mounted to a door and pivotally coupled to the mounting flange. The strap assembly including a strap, a cylinder portion coupled to the strap, and a mounting assembly coupled to the cylinder portion. The cylinder portion has an elongated slot with an enlarged portion straddled by two oppositely disposed narrowed portions. The enlarged portion has a select width and the narrowed portions each having a select width less than the enlarged portion select width. The mounting assembly includes a lower strap bearing removably mounted to a lower end of the cylinder portion, an upper strap bearing removably mounted to an upper end of the cylinder portion, and a mounting rod extending through the upper hinge arm, the upper strap bearing, the lower strap bearing, and the lower strap arm. The lower strap bearing has a locking flange with a narrow portion configured to be received within one of the cylinder portion elongated slot narrowed portion and an enlarged portion configured to be removably received within the other cylinder portion elongated slot enlarged portion. The upper strap bearing has a locking flange with a narrow portion configured to be received within one of the cylinder portion elongated slot narrowed portion and an enlarged portion configured to be removably received within the other cylinder portion elongated slot enlarged portion.

DETAILED DESCRIPTION

Figure 1:
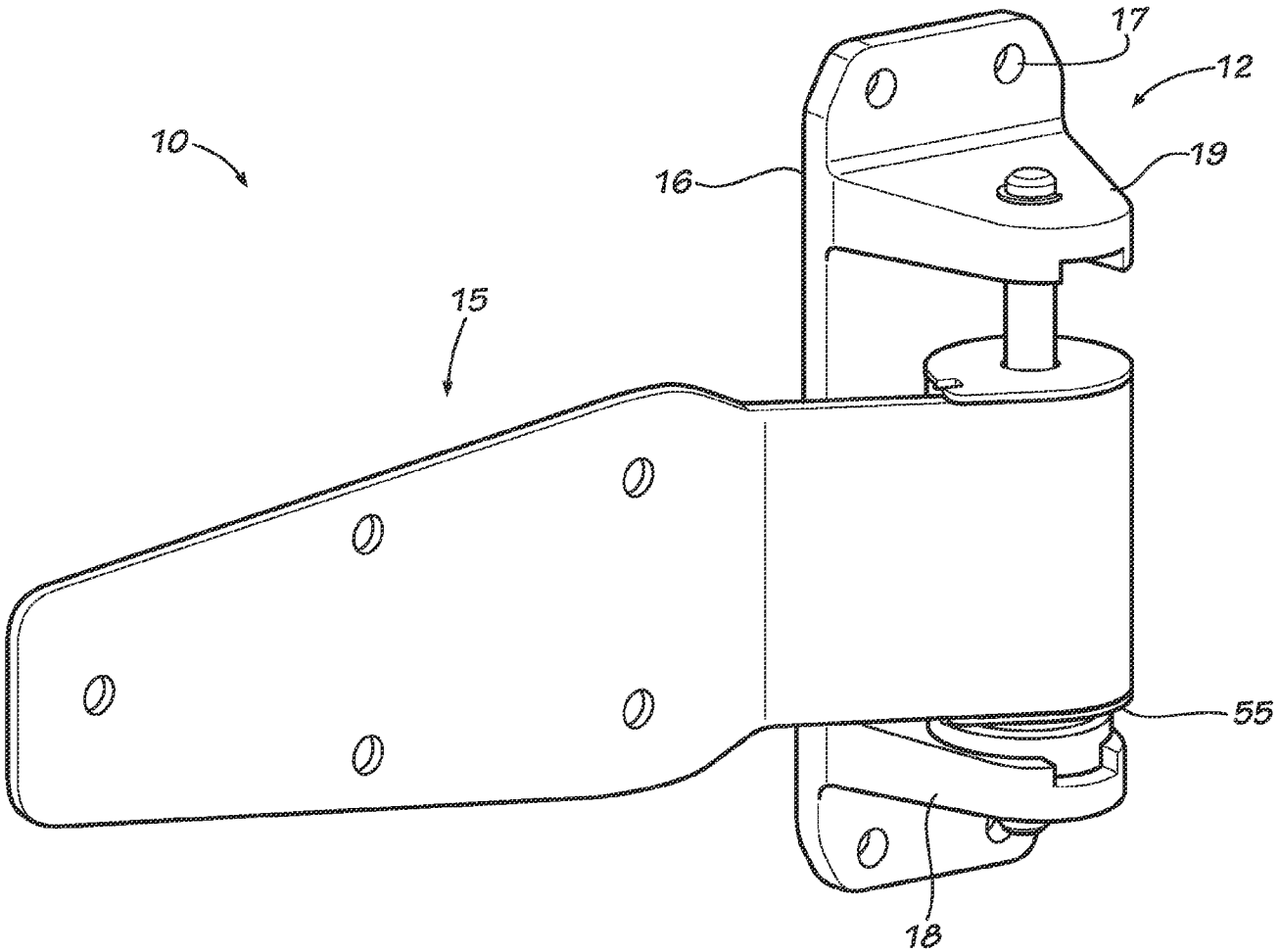
FIG. 1 is a perspective view of the riser hinge embodying principles of the invention in a preferred form, shown in a door closed position.

With reference next to the drawings, there is shown a riser hinge 10 according to the present invention. The hinge 10 includes a mounting flange assembly 12 pivotally coupled to a strap assembly 15. It is to be appreciated that the hinge 10 shown in the drawings is configured for use with a walk-in refrigerator or freezer door. The jamb and doors are well-known in the art and need not be disclosed further herein. It is to be further appreciated that the hinge 10, either alone or in combination with another hinge in accordance with the present invention, support a door (not shown) in the usual manner.

The mounting flange assembly 12 includes a mounting flange 16 having four mounting holes 17 therethrough adapted to receive unshown mounting bolts or screws, a lower hinge arm 18 generally extending perpendicularly from the mounting flange 16, and an upper hinge arm 19 generally extending perpendicularly from the mounting flange 16. The upper hinge aim 19 has an inwardly tapered groove 20 extending from a bottom surface 21 and a rod mounting hole 22 extending therethrough. Similarly, the lower arm 18 has an inwardly tapered groove 24 extending from the top surface 25 and a rod mounting hole 26 extending therethrough.

The strap assembly 15 includes a camming assembly 27 having a multi-lobed cam 28 coupled to the lower hinge arm 18 which enables the hinge to be a riser type hinge. The cam 28 has a lower plate 29 and a cylindrical camming portion 30 extending upwardly from the lower plate 29 and having a top surface 31 opposite the lower plate 29. The lower plate 29 has two oppositely disposed guides or guide blocks 32 configured to removably mate with the tapered groove 24 extending from the lower hinge arm 18 to prevent relative rotation therebetween. The camming portion 30 and lower plate 29 have a central rod mounting hole 33 therethrough. The camming portion 30 is made entirely of a smooth, low-frictional, plastic material such as nylon.

The camming portion 30 also has a generally helical first groove or flight 35 therein extending from the top surface 31 and a generally helical second groove or flight 36 extending from the top surface 31. The first and second grooves 35 and 36 are positioned laterally offset from each other so that therebetween the camming portion is formed with a large lobe 38 and a small lobe 39. The large lobe 38 has an upwardly extending, helical top bearing surface 41 which extends to a generally flat, large top dwell surface or landing 42. The small lobe 39 has an upwardly extending, helical top bearing surface 43 which extends to a generally flat, small top dwell surface or landing 44. The large and small top dwell surfaces generally form top surface 31. The large lobe top dwell surface 41 is of a select size (arcuate span or length), while the small lobe top dwell surface 44 has with a select size (arcuate span or length) smaller than that of the large top dwell surface 42. The large top dwell surface 42 extends arcuately approximately 140 degrees about the center of the camming portion. The small lobe top dwell surface 44 extends arcuately approximately 60 degrees about the center of the camming portion. As such, the camming portion first groove has a first top opening 45 with a spacing of approximately 80 degrees about the center and the second groove 36 has a second top opening 46 with a spacing of approximately 80 degrees about the center.

The strap assembly 15 also includes a strap 51 extending from a cylinder portion or barrel 52. The strap 51 includes four mounting holes 53. The term cylinder portion is meant to describe the enlarged casing located at the end of the strap. The term cylinder portion is not intended to be limited to a cylinder shape, as this portion or parts of this portion may be of many known shapes and are not necessarily cylindrical in shape. The cylindrical portion 52 includes an upper strap bearing 54 mounted partially within the cylindrical portion 52, and a lower strap bearing 55, in the form of a cam follower 56, mounted partially within the cylindrical portion 52. The cam follower 56 is a component of the camming assembly 27. The upper strap bearing 54 has a central rod mounting hole 58 therethrough. The lower strap bearing 55 has a central rod mounting hole 60 therethrough. A shoulder bolt or rod 61 extends through the upper hinge arm mounting rod hole 22, the upper strap bearing mounting hole 58, the lower strap bearing mounting hole 60, and through the lower hinge arm mounting rod hole 26. A locking c-ring 62 is mounted into a ring groove 63 on both the upper and lower ends of the rod 61 to maintain it in place.

The cam follower 56 has a lower plate 65 and a cylindrical cam following portion 66 defined by a cylindrical exterior wall 67 extending upwardly from the lower plate 65. The cam follower 56 is made entirely of smooth, low-frictional, plastic material such as nylon. The cylindrical cam following portion 66 has two asymmetrically positioned helical grooves 68 therein which form two asymmetrical cam following ridges 69. The asymmetrical configuration of the grooves 69 creates a first, large ridge 70 and a second, small ridge 71. The large ridge 70 has a large bottom bearing surface 73 having a helical rising portion 74 extending to a generally flat resting or dwell portion 75. The large bottom bearing surface 73 is configured to mate with the large lobe top bearing surface 41. The small ridge 71 has a small bottom bearing surface 77 having a helical rising portion 78 extending to a generally flat resting or dwell portion 79. The small bottom bearing surface 77 is configured to mate with the small lobe top bearing surface 43. The resting portions 75 and 79 each extend arcuately approximately 50 degrees about the center of the cylindrical portion 66. The large ridge 70 is sized and shaped to fit within the first groove 35 of the cam 28 while the small ridge 71 is sized and shaped to fit within the second groove 36 of the cam 28. As such, the bottom bearing surface 77 of the small ridge 71 rides upon or bears against the top bearing surface 43 of the small lobe 39. Similarly, the bottom bearing surface 73 of the large ridge 70 rides upon or bears against the top bearing surface 41 of the large lobe 38.

The strap cylinder portion 52 has a gap, groove, or space 82 adjacent the strap 51. The space 82 includes an enlarged portion 83 flanked by narrowed portions 84 at stop ledges 85. The upper strap bearing 54 and cam follower 56 each have a vertically oriented, elongated, locking tongue or flange 87 with a narrowed portion 88 extending to an enlarged portion or stop 89. The narrowed portion 88 is configured to fit within the narrowed portion 84 of the space 82, while the enlarged portion 89 is configured to removably fit within the enlarged portion 83 of the space 82. With this construction, the upper strap bearing 54 and cam follower 56 may be removed from the cylinder portion 52 by first horizontally and then vertically forcing the cam and cam follower enlarged portions 89 over the stop ledges 85 of the space 82 and into the narrowed portions 84 of the space, thereby releasing them and allowing them to be vertically removed and easily replaced in the event of excessive wear upon these components. The cam follower and upper strap may include screw holes to allow screws to be passed through thereby securing these components together.

In use, the hinge 10 is mounted to the refrigerator or freezer door in the conventional manner as is well known in the art. The mounting flange 16 is secured to the jamb by the use of screws (not shown) that extend through the mounting flange mounting holes 17 and into the jamb. A conventional walk-in refrigerator or freezer door is similarly secured to the hinge 10 by four screws (not shown) that extend through the four mounting holes 53 of the strap assembly.

Figure 2:
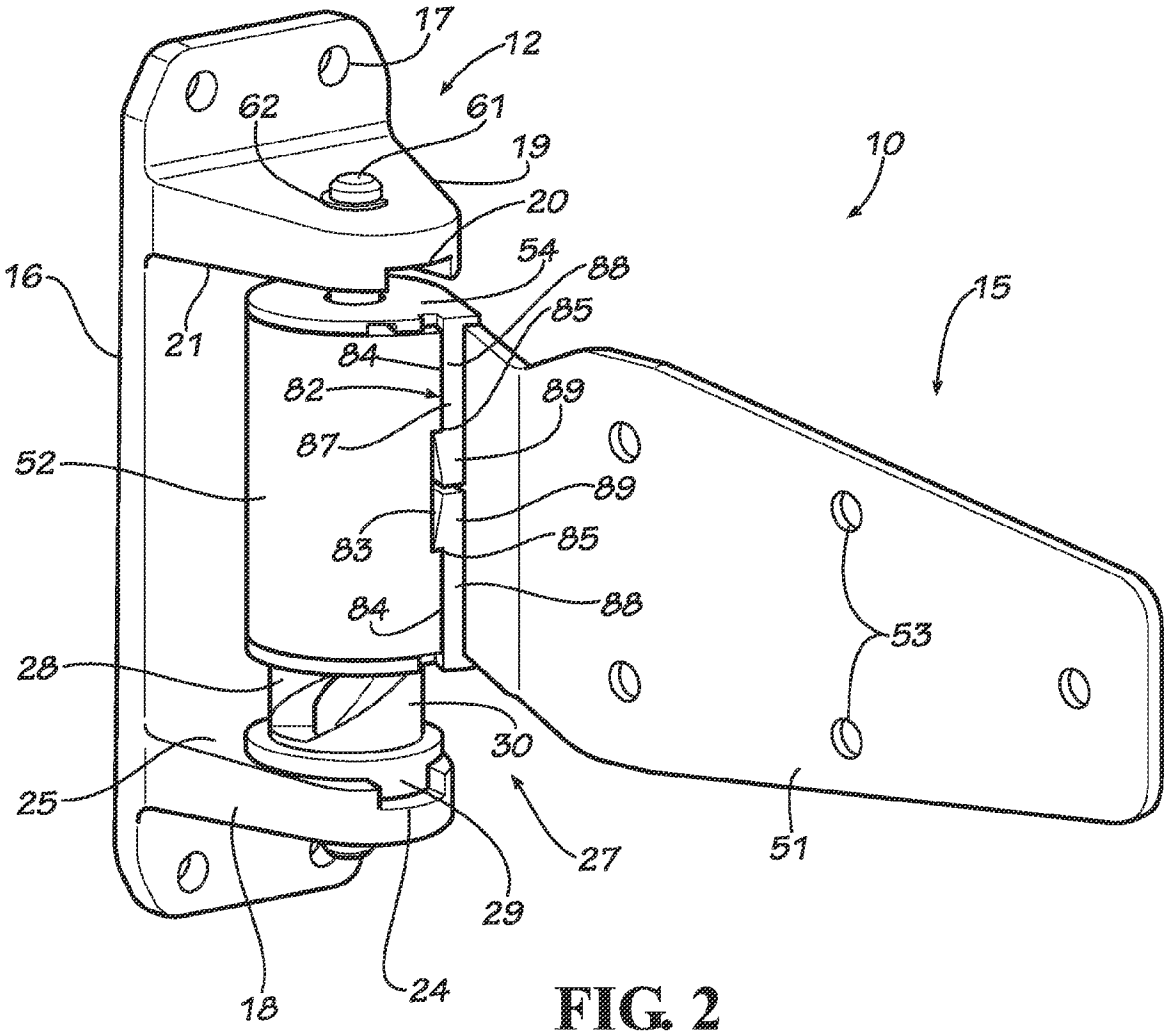
FIG. 2 is a perspective view of the riser hinge of FIG. 1, shown in a door half open position.
Figure 3:
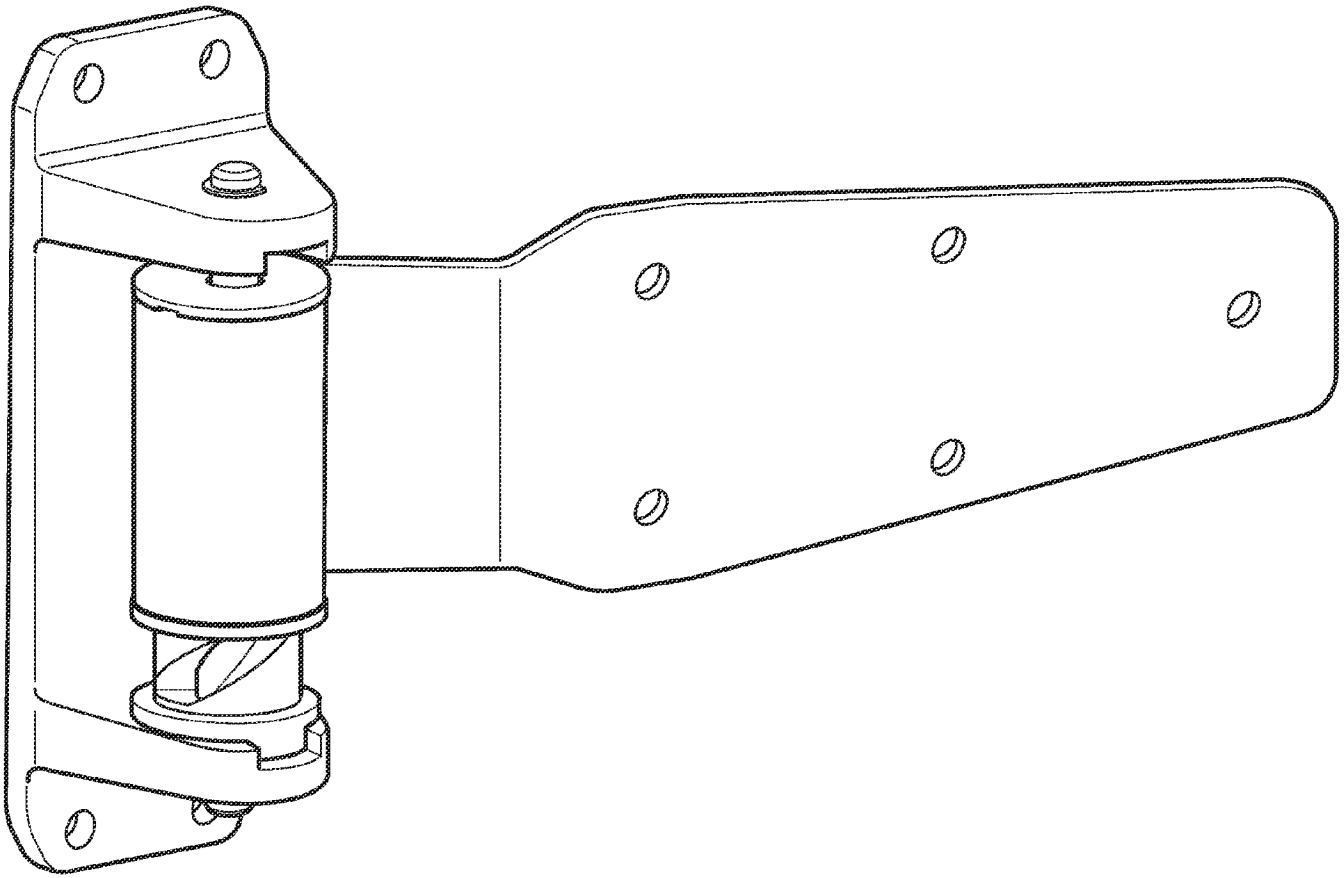
FIG. 3 is a perspective view of the riser hinge of FIG. 1, shown in a door open position.
Figure 4:
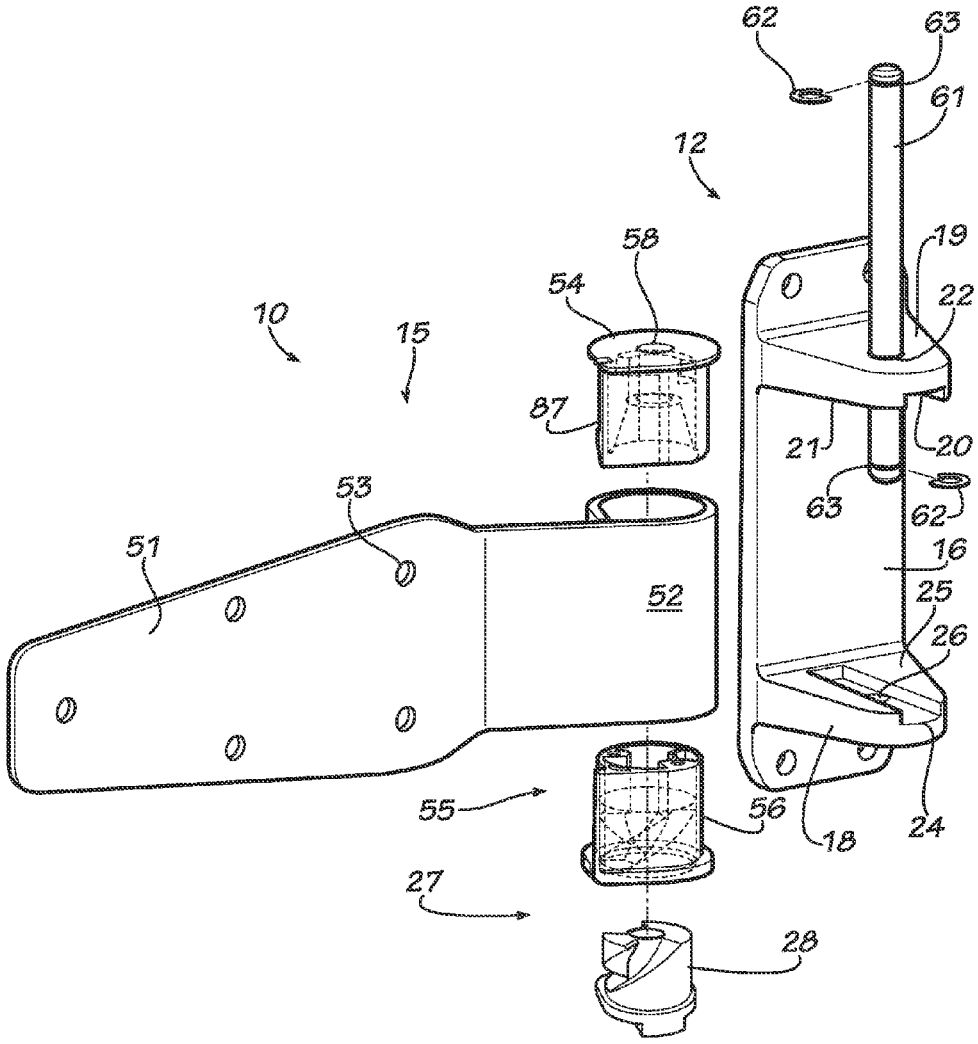
FIG. 4 is an exploded view of the riser hinge of FIG. 1.
Figure 5:
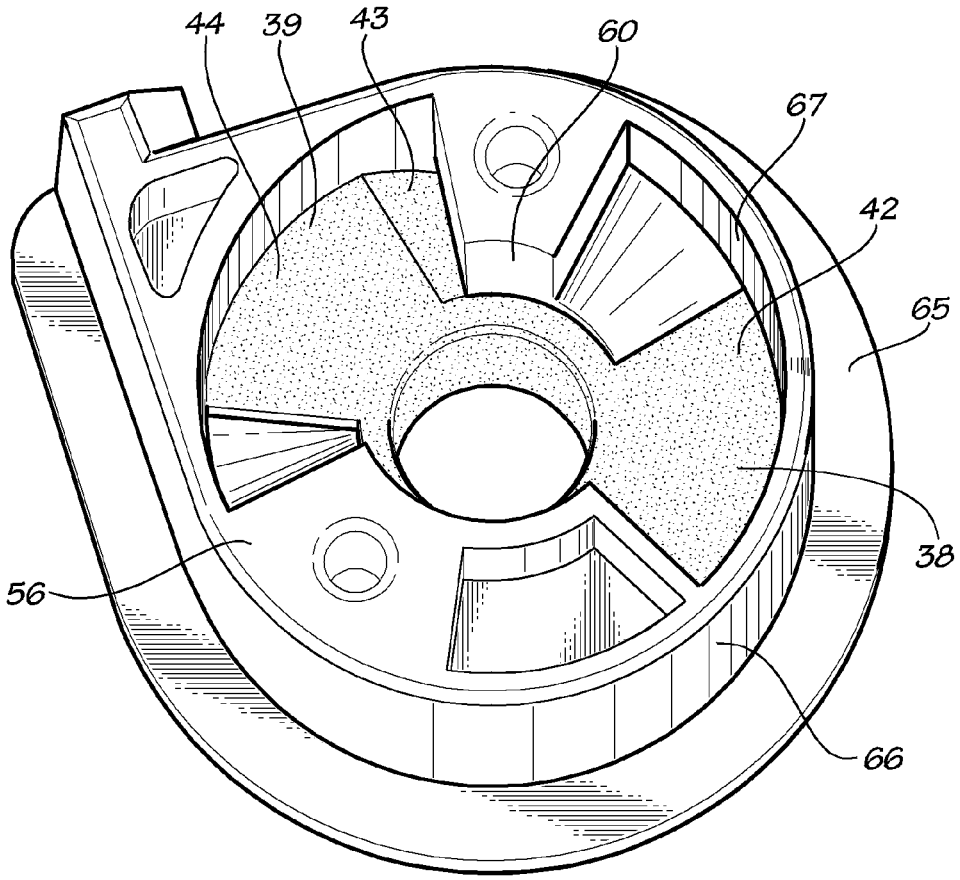
FIG. 5 is a top view of the cam and cam follower of the riser hinge of FIG. 1.
Figure 6:
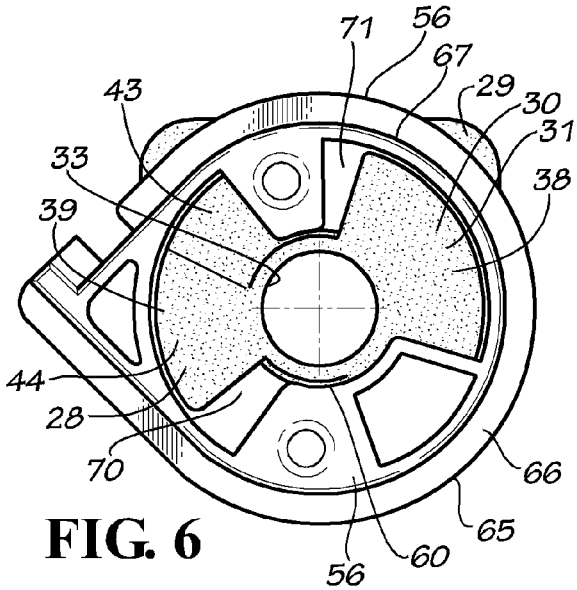
FIGS. 6-8 are a series of views showing the cam and cam follower from a door closed position to a door open position.
Figure 7:
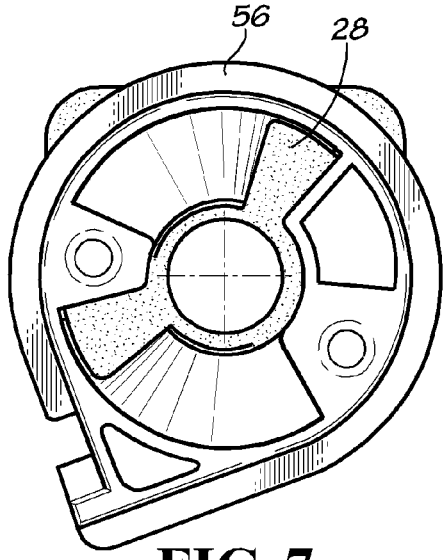
Figure 8:
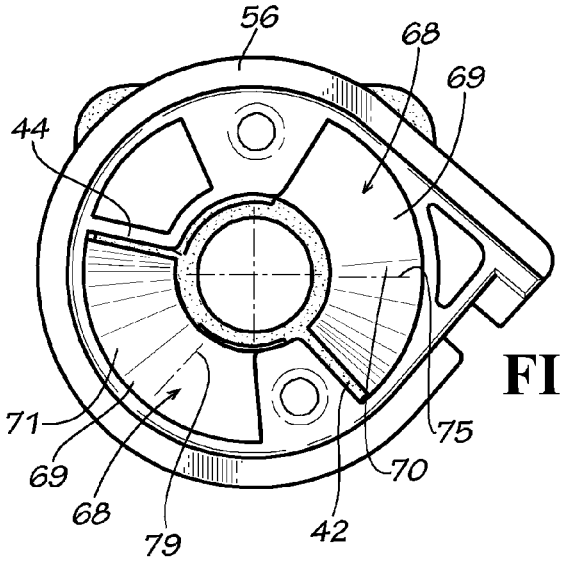
Figure 9:
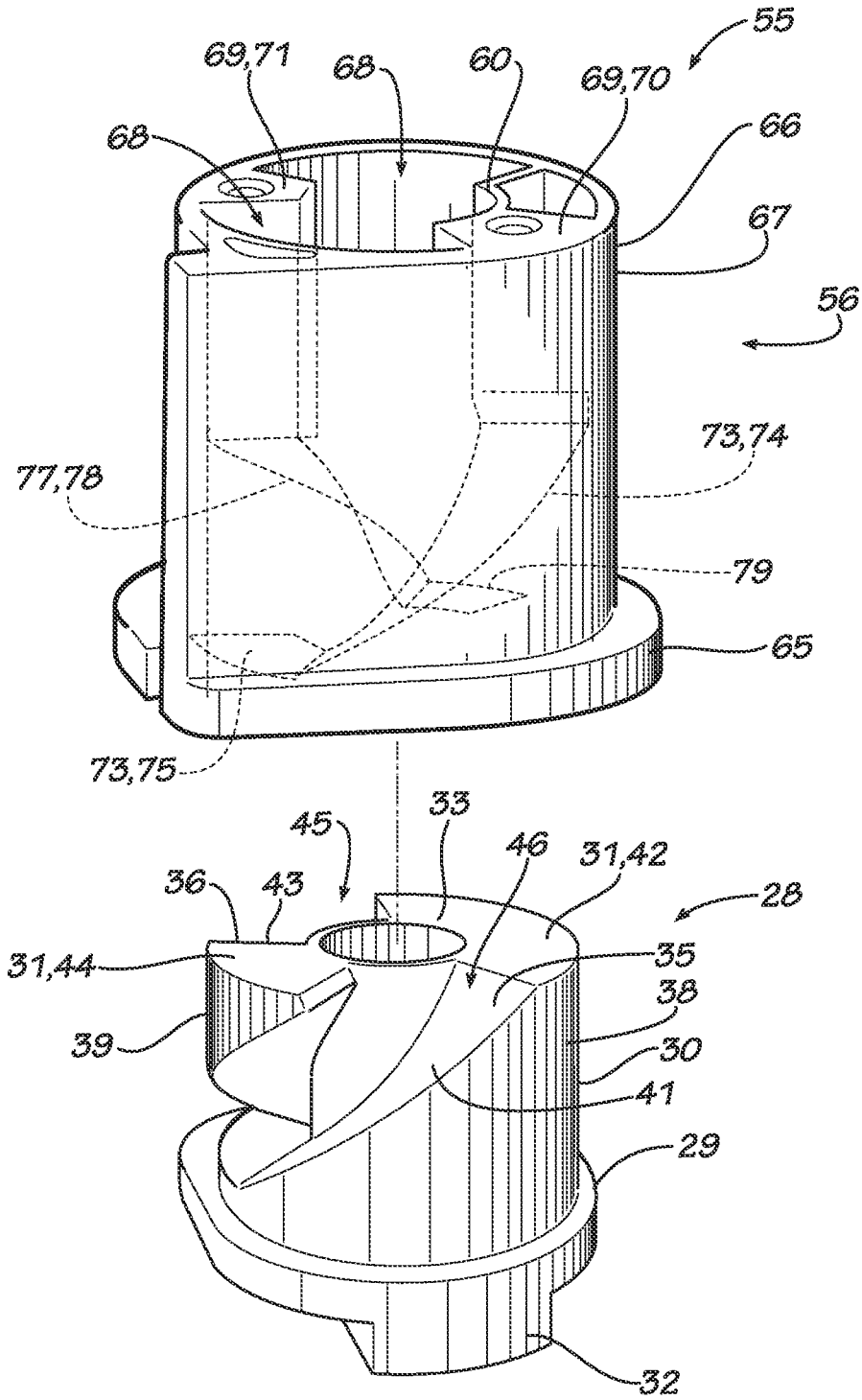
FIG. 9 is a top view of the cam and cam follower of the riser hinge of FIG. 1.

As the door is swung open, from a door closed position shown in FIGS. 1 and 6, the cam follower 56 rotates about the hinge rod 61 and upon the underlying cam 28. As this occurs, the helical cam follower large ridge 70 and small ridge 71 ride upwardly upon the cam large lobe 38 and small lobe 39, respectively, as shown in FIGS. 2 and 7. The cam follower 56 rotates in this manner until the cam follower rising portions 74 and 78 crest the cam lobe top bearing surfaces 41 and 43 and the cam follower flat resting portions 75 and 79 ride onto the cam top dwell surfaces 42 and 44. The initial movement of the cam follower causes it to rise relative to the cam, and thus the door rises relative to the structure to which it is mounted and underlying floor. Once the cam follower flat resting portions 75 and 79 ride onto the cam top dwell surfaces 42 and 44 the lifting of the door ceases and the door simply continues to rotate open without any vertical movement, as shown in FIGS. 3 and 8. Thus, if the door is now released it will tend to remain stationary. Conversely, should the door be released before this occurs, the weight of the door will cause the camming to close the door as the cam follower rides down the cam and is returned to its at rest, closed position.

It should be understood that if the cam grooves and resulting lobes were symmetrical the over rotation of the door opening movement would cause the ridges 70, 71 to fall into the opposite grooves 35, 36 causing a disastrous situation. Also, the door would not be capable of moving much further past its dwell point due to the limited amount of dwell contact surface between the cam top dwell surfaces and cam follower flat resting portions. However, by creating an asymmetrical arrangement of the cam grooves 35 and 36 and large and small lobes 38 and 39, and the asymmetrical arrangement of the cam follower grooves 68 and large and small ridges 70 and 71 this situation does not occur. As the cam follower is rotated past the initial dwell point the ridges' flat resting portions 75 and 79 ride upon the lobe top dwell surfaces 42 and 44, wherein the extended length (large arcuate length) of the large lobe top dwell surface 41 allows extended contact and thus rotation. Additionally, this insures that contact always exists between the lobes and the ridges as they are laterally offset from each other, as the cam large lobe top dwell surface 42 is larger than the opposite groove opening between the cam follower ridges flat resting portions 75 and 79, i.e., the cam large lobe top dwell spans or bridges the space of the opposite groove and the large ridge flat resting portion remains on the large lobe top dwell surface even when the small ridge flat resting portion extends over the first groove top opening 45.

It should also be understood that the upper hinge arm 19 also includes a tapered groove 20 even though such is not utilized in the drawings. However, should an installer wish to install the hinge as a left hand hinge, as opposed to the right hand hinge arrangement shown in the drawings, the installer simply inverts the mounting flange 16 so that the upper hinge arm 19 becomes a lower hinge arm 18, the upper strap bearing 54 and lower strap bearing 55 are removed and replaced with oppositely oriented bearings within the strap cylindrical portion 52.

It should be understood that the positioning, configuration, or orientation of the cam and cam follower may be reversed, as such, the terms cam and cam follower may be used interchangeably. It should also be understood that while the space 82 is shown as one continuous space, it could be formed as two spaces extending from opposite ends of the cylinder portion. In such a case, the centrally located enlarged portion 83 would have two separate enlarged portions rather than the one continuous enlarged portion which comprises of two co-extending enlarged portions.

It thus is seen that a riser hinge is now provided which overcomes problems long associated with those of the prior art. It should, however, be understood that the just described embodiments merely illustrate principles of the invention in two preferred forms. Many modifications, additions and deletions may, of course, be made thereto without departure from the spirit and scope of the invention as set forth in the following claims.

The invention claimed is:

1. A hinge for doors being suited from mating engagement with an associated cabinet or jamb, the hinge comprising:

a mounting flange adapted to be mounted to a jamb, said mounting flange having an upper hinge arm and a lower hinge arm, and a strap assembly adapted to be mounted to a door and pivotally coupled to said mounting flange, said strap assembly including a strap, a cylinder portion coupled to said strap, and a mounting assembly coupled to said cylinder portion, said cylinder portion having an elongated slot with an enlarged portion straddled by two oppositely disposed narrowed portions, said enlarged portion having a select width and said narrowed portions each having a select width less than said enlarged portion select width, said mounting assembly includes lower strap bearing bar removably mounted to a lower end of said cylinder portion, an upper strap bearing removably mounted to an upper end of said cylinder portion, and a mounting rod extending through said upper hinge arm, said upper strap bearing, said lower strap bearing, and said lower strap arm, said lower strap bearing having a locking flange with a narrow portion configured to be received within one said cylinder portion elongated slot narrowed portion and an enlarged portion configured to be removably received within said cylinder portion elongated slot enlarged portion, said upper strap bearing having a locking flange with a narrow portion configured to be received within one said cylinder portion elongated slot narrowed portion and an enlarged portion configured to be removably received within said cylinder portion elongated slot enlarged portion.

2. The hinge of claim 1 wherein said lower strap bearing includes a cam and a cam follower.

3. The hinge of claim 2 wherein said cam has two asymmetrically positioned cam lobes, and wherein said cam follower has two asymmetrically positioned cam following ridges configured to mate and ride upon said cam lobes, one said cam lobe having a first dwell portion of a select length and said other cam lobe having a dwell portion of a select length larger than said select length of said first dwell portion.

4. The hinge of claim 2 wherein said lower hinge arm includes a mounting groove and wherein said cam includes a guide configured to be received within said lower hinge arm mounting groove.

5. A hinge for doors being suited from mating engagement with an associated cabinet or jamb, the hinge comprising:

a mounting flange having an upper hinge arm and a lower hinge arm, and a strap assembly pivotally coupled to said mounting flange, said strap assembly including a strap, a barrel portion coupled to said strap, and a mounting assembly removably coupled to said barrel portion, said barrel portion having a first elongated slot with a first portion of a select size and a second portion of a select size smaller than said first portion select size, said barrel portion also having a second elongated slot with a third portion of a select size and a fourth portion of a select size smaller than said third portion select size, said mounting assembly includes a lower strap bearing removably mounted to a lower end of said barrel portion, and an upper strap bearing removably mounted to an upper end of said barrel portion, said lower strap bearing having a locking flange with a first portion configured to be received within said barrel portion elongated slot first portion and a second portion configured to be removably received within said barrel portion elongated slot second portion, said upper strap bearing having a locking flange with a third portion configured to be received said barrel portion elongated slot third portion and a second portion configured to be removably received within said barrel portion elongated slot third portion.

6. The hinge of claim 5 wherein said lower strap bearing includes a cam and a cam follower.

7. The hinge of claim 6 wherein said cam has two asymmetrically positioned cam lobes, and wherein said cam follower has two asymmetrically positioned cam following ridges configured to mate and ride upon said cam lobes, one said cam lobe having a first dwell portion of a select length and said other cam lobe having a dwell portion of a select length larger than said select length of said first dwell portion.

8. The hinge of claim 6 wherein said lower hinge arm includes a mounting groove and wherein said cam includes a guide configured to be received within said lower hinge arm mounting groove.

9. A hinge for doors being suited from mating engagement with an associated cabinet or jamb, the fringe comprising:

a mounting flange adapted to be mounted to a iamb, said mounting flange having an upper hinge arm and a lower hinge arm, and a strap assembly adapted to be mounted to a door and pivotally coupled to said mounting flange, said strap assembly including a strap, a cylinder portion coupled to said strap, and a mounting assembly coupled to said cylinder portion, said cylinder portion having an elongated mounting groove, said mounting assembly includes a lower strap bearing removably mounted to a lower end of said cylinder portion and having a first tongue configured to be received within said cylinder portion mounting groove, an upper strap bearing removably mounted to an upper end of said cylinder portion and having a second tongue configured to be received within said cylinder portion mounting groove, and a mounting rod extending through said upper hinge arm, said upper strap bearing, said lower strap bearing, and said lower strap arm, wherein said groove has an enlarged portion straddled by two oppositely disposed narrowed portions, said enlarged portion having a select width and said narrowed portions each having select width less than said enlarged portion select width, and wherein said lower strap bearing tongue has a narrow portion configured to be received within one said cylinder portion groove narrowed portion and an enlarged portion configured removably received within said cylinder portion groove enlarged portion, and wherein said upper strap bearing tongue has a locking flange with a narrow portion configured to be received within one said cylinder portion groove narrowed portion and an enlarged portion configured to be removably received within said cylinder portion groove enlarged portion.

10. The hinge of claim 9 wherein said lower strap bearing includes a cam and a cam follower.

11. The hinge of claim 10 wherein said cam has two asymmetrically positioned cam lobes, and wherein said cam follower has two asymmetrically positioned cam following ridges configured to mate and ride upon said cam lobes, one said cam lobe having a first dwell portion of the select length and said other cam love having dwell portion of a select length larger than said select length of said first dwell portion.

12. The hinge of claim 10 wherein said lower hinge arm includes a mounting groove and wherein said cam includes a guide configured to be received within said lower hinge arm mount groove.

* * * * *